US009527128B2

(12) United States Patent
Nakamura et al.

(10) Patent No.: US 9,527,128 B2
(45) Date of Patent: Dec. 27, 2016

(54) IRONING MOLD AND FORMED MATERIAL MANUFACTURING METHOD

(71) Applicant: NISSHIN STEEL CO., LTD., Tokyo (JP)

(72) Inventors: Naofumi Nakamura, Osaka (JP); Yudai Yamamoto, Osaka (JP); Jun Kurobe, Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 14/768,866

(22) PCT Filed: Jul. 10, 2013

(86) PCT No.: PCT/JP2013/068880

§ 371 (c)(1),
(2) Date: Aug. 19, 2015

(87) PCT Pub. No.: WO2014/207947

PCT Pub. Date: Dec. 31, 2014

(65) Prior Publication Data

US 2016/0001349 A1 Jan. 7, 2016

(30) Foreign Application Priority Data

Jun. 28, 2013 (JP) ..... 2013-135859

(51) Int. Cl.
*B21J 13/02* (2006.01)
*B21D 51/16* (2006.01)
(Continued)

(52) U.S. Cl.
CPC ..... *B21J 13/02* (2013.01); *B21D 22/28* (2013.01); *B21D 22/30* (2013.01); *B21D 51/16* (2013.01); *B21K 5/20* (2013.01); *B21K 23/00* (2013.01)

(58) Field of Classification Search
CPC ..... B21D 22/30; B21D 22/00; B21D 22/02; B21D 22/20; B21D 22/28; B21D 22/025; B21D 22/203; B21D 22/201; B21D 22/21; B21J 13/02; B21J 5/025
(Continued)

(56) References Cited

U.S. PATENT DOCUMENTS 4,425,778 A 1/1984 Franek et al.
5,179,854 A * 1/1993 Matsui ..... B21D 22/28 72/349
(Continued)

FOREIGN PATENT DOCUMENTS

EP 0664169 A1 8/1994
EP 0667193 A1 8/1995
(Continued)

OTHER PUBLICATIONS

International Search Report issued in PCT Application No. PCT/JP2013/068880 on Sep. 10, 2013, 2 pages.
(Continued)

*Primary Examiner* — Jimmy T Nguyen
*Assistant Examiner* — Gregory Swiatocha
(74) *Attorney, Agent, or Firm* — Rothwell, Figg, Ernst & Manbeck, P.C.

(57) ABSTRACT

An ironing mold according to the present invention includes a punch that is inserted into a formed portion, and a die having a pushing hole into which the formed portion is pushed together with the punch. An inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction.

8 Claims, 6 Drawing Sheets

(51) Int. Cl.

| | |
|---|---|
| ***B21K 23/00*** | (2006.01) |
| ***B21K 5/20*** | (2006.01) |
| ***B21D 22/28*** | (2006.01) |
| ***B21D 22/30*** | (2006.01) |

(58) Field of Classification Search
USPC ..... 72/347, 352, 358
See application file for complete search history.

(56) References Cited

U.S. PATENT DOCUMENTS

| | | | | | |
|---|---|---|---|---|---|
| 5,249,447 | A | * | 10/1993 | Aizawa | B21D 22/201 72/349 |
| 5,590,558 | A | * | 1/1997 | Saunders | B21D 22/201 72/346 |
| 5,778,722 | A | * | 7/1998 | Saiki | B21D 51/26 72/347 |

FOREIGN PATENT DOCUMENTS

| | | | |
|---|---|---|---|
| JP | S5462967 | A | 5/1979 |
| JP | S60-152321 | A | 8/1985 |
| JP | S64-34524 | A | 2/1989 |
| JP | 5-50151 | A | 3/1993 |
| JP | 9-295071 | A | 11/1997 |
| JP | 2004-202534 | A | 7/2004 |
| JP | 2006-193776 | A | 7/2006 |
| JP | 2009-44599 | A | 2/2009 |
| JP | 2010-110776 | A | 5/2010 |

OTHER PUBLICATIONS

Office Action issued in Canadian Patent Application No. 2905000 on Oct. 30, 2015, 5 pages.
Supplementary European Search Report dated Sep. 16, 2016, Issued for European application No. 13867981.2, 8 pages.

* cited by examiner

IRONING MOLD AND FORMED MATERIAL MANUFACTURING METHOD

CROSS REFERENCE TO RELATED APPLICATIONS

This application is a 35 U.S.C. §371 National Phase Entry Application from PCT/JP2013/068880, filed Jul. 10, 2013, and designating the United States, which claims priority under 35 U.S.C. §119 to Japanese Patent Application No. 2013-135859 filed Jun. 28, 2013, which is incorporated herein by reference in its entirety.

TECHNICAL FIELD

The present invention relates to an ironing mold used to perform ironing on a formed portion, and a formed material manufacturing method.

BACKGROUND ART

A convex formed portion is typically formed by performing a press forming such as drawing using a surface treated metal plate such as a coated steel plate as a raw material. When the formed portion requires particularly high dimensional precision, ironing is implemented on the formed portion after the formed portion is formed. Ironing is a processing method of setting a clearance between a punch and a die to be narrower than a plate thickness of the formed portion prior to ironing, and then ironing a plate surface of the formed portion using the punch and the die so that the plate thickness of the formed portion matches the clearance between the punch and the die.

A configuration disclosed in Patent Document 1 below, for example, may be employed as a mold used for ironing. That is, the conventional mold includes a punch and a die. The punch is a columnar member having an outer peripheral surface that linearly extends parallel to a pushing direction into a pushing hole, and is inserted into a formed portion. The die has the pushing hole into which the formed portion is pushed together with the punch. The pushing hole has a shoulder portion disposed on an outer edge of an inlet of the pushing hole and is constituted by a curved surface having a predetermined curvature radius, and an inner peripheral surface that linearly extends from a radius end of the shoulder portion parallel to the pushing direction. When the formed portion is pushed into the pushing hole, the plate surface thereof is ironed by the shoulder portion so as to gradually decrease in thickness to the width of the clearance between the outer peripheral surface of the punch and the inner peripheral surface of the pushing hole.

Patent Document 1: Japanese Patent Application Publication H5-50151

DISCLOSURE OF THE INVENTION

The plate thickness of the formed portion prior to ironing is uneven in the pushing direction. More specifically, the plate thickness of a rear end side of the formed portion in the pushing direction is often thicker than the plate thickness of a front end side of the formed portion. The reason why the rear end side is thicker is that the front end side is stretched to a greater extent than the rear end side when the formed portion is formed.

In the conventional mold described above, the outer peripheral surface of the punch and the inner peripheral surface of the pushing hole extend parallel to each other.

Accordingly, the clearance between the outer peripheral surface of the punch and the inner peripheral surface of the pushing hole is uniform in the pushing direction, and therefore the thick part of the formed portion is subjected to a larger amount of ironing. Hence, a surface treated layer of the part having the increased plate thickness is shaved, and as a result, a powdery residue may be generated. The powdery residue causes problems such as formation of minute pockmarks (dents) in the surface of the ironed formed portion and deterioration of the performance of a product manufactured using the formed material.

The present invention has been designed to solve the problems described above, and an object thereof is to provide an ironing mold and a formed material manufacturing method with which generation of a large load on a part of a surface treated layer can be avoided so that an amount of generated powdery residue can be reduced.

An ironing mold according to the present invention is an ironing mold for performing ironing on a convex formed portion formed using a surface treated metal plate as a raw material, including: a punch that is inserted into the formed portion; and a die having a pushing hole into which the formed portion is pushed together with the punch, wherein the pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, and the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction.

A formed material manufacturing method according to the present invention includes the steps of: forming a convex formed portion by performing at least one forming process on a surface treated metal plate; and performing ironing on the formed portion using an ironing mold after forming the formed portion, wherein the ironing mold includes: a punch that is inserted into the formed portion; and a die having a pushing hole into which the formed portion is pushed together with the punch. The pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, and the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction.

With the ironing mold and the formed material manufacturing method according to the present invention, the inner peripheral surface of the pushing hole extends non-parallel to the outer peripheral surface of the punch, and the inner peripheral surface is provided with a clearance that corresponds to the uneven plate thickness distribution, in the pushing direction, of the formed portion prior to the ironing relative to the outer peripheral surface to ensure that the amount of ironing applied to the formed portion remains constant in the pushing direction. Therefore, generation of a large load on a part of a surface treated layer can be avoided, and as a result, the amount of generated powdery residue can be reduced.

BEST MODE FOR CARRYING OUT THE INVENTION

Embodiments of the present invention will be described below with reference to the drawings.

First Embodiment

Figure 1:
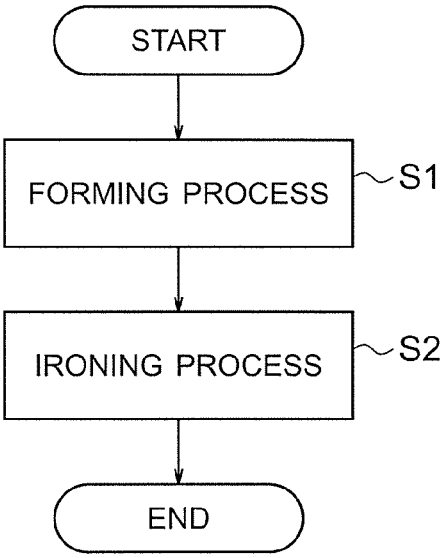
FIG. 1 is a flowchart showing a formed material manufacturing method according to an embodiment of the present invention.
Figure 2:
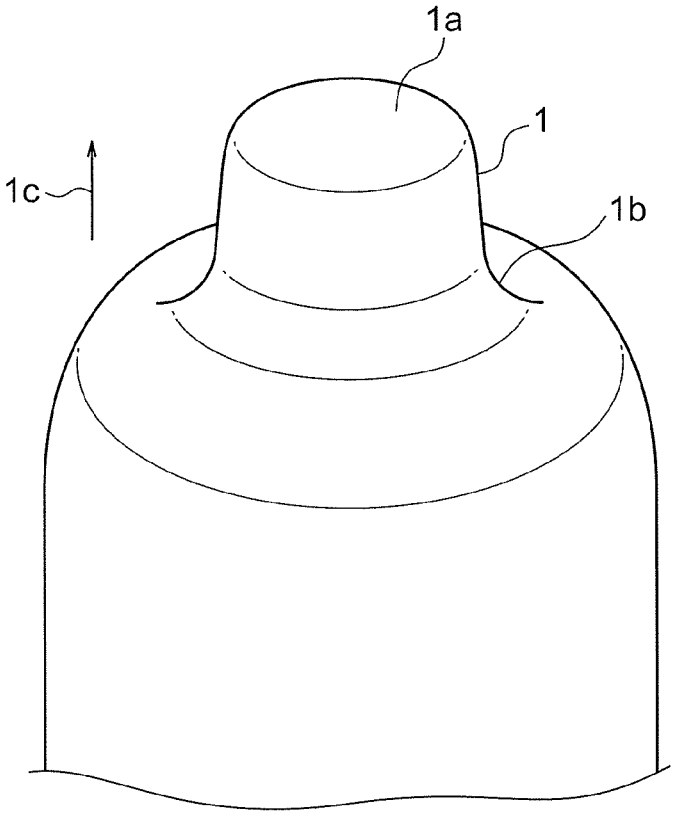
FIG. 2 is a perspective view showing a formed material including a formed portion formed by a forming process shown in FIG. 1.
Figure 3:
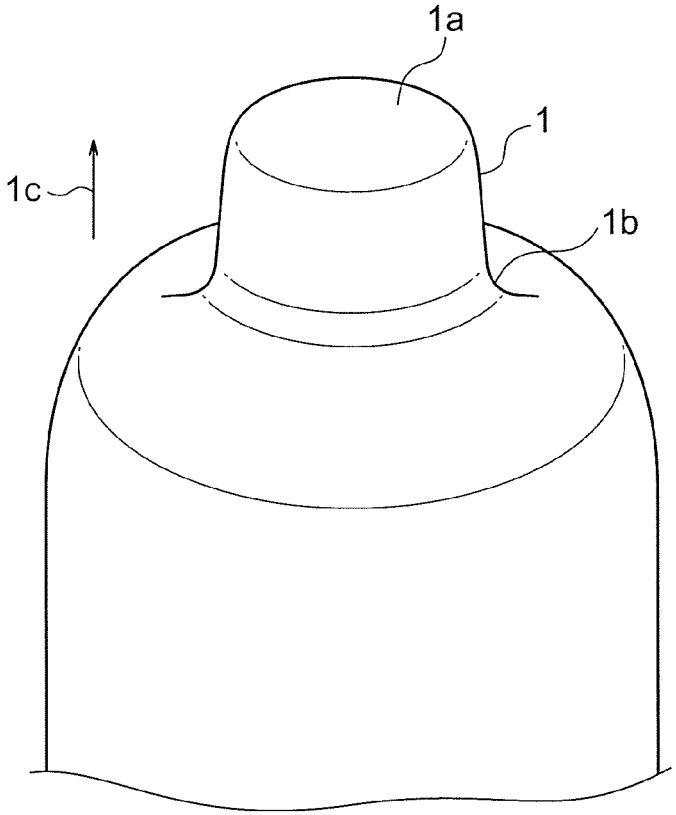
FIG. 3 is a perspective view showing the formed material including the formed portion following an ironing process shown in FIG. 1.

FIG. 1 is a flowchart showing a formed material manufacturing method according to an embodiment of the present invention. FIG. 2 is a perspective view showing a formed material including a formed portion 1 formed by the forming process S1 shown in FIG. 1. FIG. 3 is a perspective view showing the formed material including the formed portion 1 following the ironing process S2 shown in FIG. 1.

As shown in FIG. 1, the formed material manufacturing method according to this embodiment includes the forming process S1 and the ironing process S2. The forming process S1 is a process for forming the formed portion 1 in a convex shape (see FIG. 2) by performing at least one forming process on a surface treated metal plate. The forming process includes a pressing process such as drawing or stretching. The surface treated metal plate is a metal plate having a surface treated layer on a surface thereof. The surface treated layer includes a painted film or a coating layer. In this embodiment, the surface treated metal plate is described as a Zn coated steel plate formed by applying a Zn (zinc) coating to a surface of a steel plate.

As shown in FIG. 2, the formed portion 1 according to this embodiment is a convex portion formed by forming the Zn coated steel plate into a cap body and then forming an apex portion of the cap body to project further therefrom. Hereafter, a direction extending from a base portion 1*b* to an apex portion 1*a* of the formed portion 1 will be referred to as a pushing direction 1*c*. The pushing direction 1*c* is a direction in which the formed portion 1 is pushed into a pushing hole (see FIG. 5) provided in a die of an ironing mold to be described below.

The ironing process S2 is a process for performing ironing on the formed portion 1 using the ironing mold to be described below. Ironing is a processing method of setting a clearance between a punch and a die of an ironing mold to be narrower than a plate thickness of a formed portion prior to ironing, and then ironing a plate surface of the formed portion using the punch and the die so that the plate thickness of the formed portion matches the clearance between the punch and the die. In other words, the thickness of the formed portion 1 following ironing is thinner than the thickness of the formed portion 1 prior to ironing.

As shown in FIG. 3, by performing ironing, a curvature radius of a curved surface constituting an outer surface of the base portion 1*b* of the formed portion 1 is reduced. A formed material manufactured by performing the forming process S1 and the ironing process S2, or in other words a formed material manufactured using the formed material manufacturing method according to this embodiment, can be used in various applications, but is used in particular in applications such as a motor cases or the like, for example, in which the formed portion 1 requires a high degree of dimensional precision.

Figure 4:
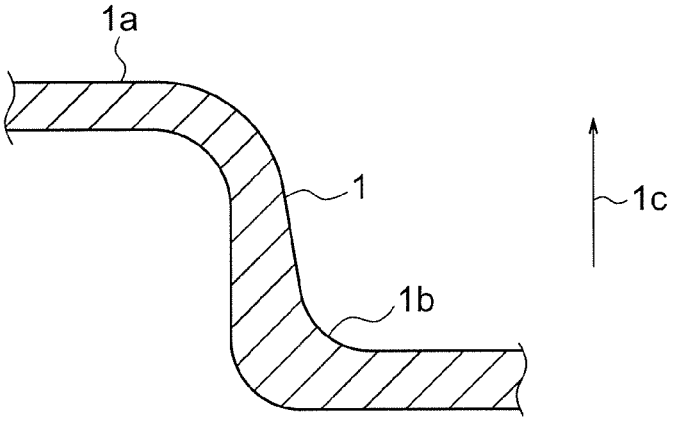
FIG. 4 is a sectional view of a formed portion 1 shown in FIG. 2.

FIG. 4 is a sectional view showing the formed portion 1 of FIG. 2. As shown in FIG. 4, the plate thickness of the formed portion 1 prior to ironing is uneven in the pushing direction 1*c*. More specifically, the plate thickness on the base portion 1*b* side of the formed portion 1 in the pushing direction 1*c* is thicker than the plate thickness on the apex portion 1*a* side of the formed portion 1. In other words, the plate thickness of the formed portion 1 decreases gradually in the pushing direction 1*c* from a rear end side (the base portion 1*b* side) toward a front end side (the apex portion 1*a* side). The reason for this uneven plate thickness distribution is that when the formed portion is formed in the forming process S1, the apex portion 1*a* side is stretched to a greater extent than the base portion 1*b* side. Note that a plate thickness reduction rate may be constant or uneven in the pushing direction 1*c*. The reduction rate is a value obtained by dividing a difference between a plate thickness $t_1$ in a predetermined position and a plate thickness $t_2$ in a position removed from the predetermined position by a unit distance d toward the front end side by the unit distance d ($=(t_2-t_1)/d$).

Figure 5:
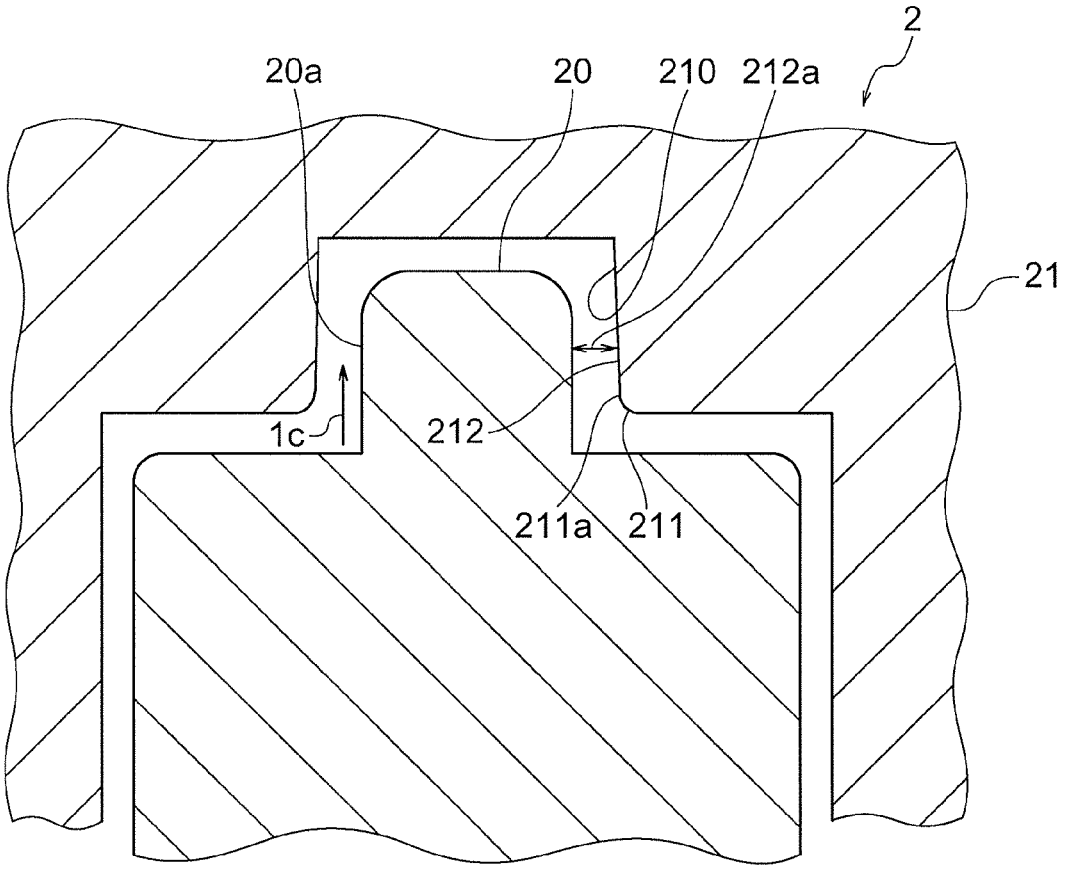
FIG. 5 is a sectional view showing an ironing mold used in the ironing process S2 shown in FIG. 1.
Figure 6:
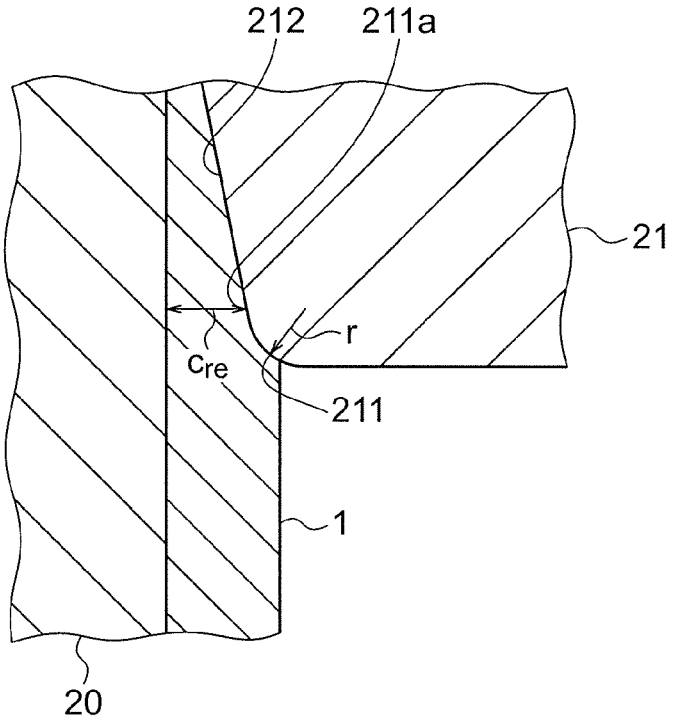
FIG. 6 is an enlarged illustrative view showing a periphery of a shoulder portion during the ironing process performed on the formed portion using the ironing mold shown in FIG. 5.

FIG. 5 is a sectional view showing an ironing mold 2 used in the ironing process S2 shown in FIG. 1, and FIG. 6 is an enlarged illustrative view showing a periphery of a shoulder portion 211 during the ironing process performed on the formed portion using the ironing mold 2 shown in FIG. 5. In FIG. 5, the ironing mold 2 includes a punch 20 and a die 21. The punch 20 is a convex body that is inserted into the formed portion 1 described above. An outer peripheral surface 20*a* of the punch 20 linearly extends parallel to the pushing direction 1*c* into a pushing hole 210.

The die 21 is a member that includes the pushing hole 210 into which the formed portion 1 is pushed together with the punch 20. The pushing hole 210 includes the shoulder portion 211 and an inner peripheral surface 212. The shoulder portion 211 is disposed on an outer edge of an inlet of the pushing hole 210, and is constituted by a curved surface having a predetermined curvature radius. The inner peripheral surface 212 is a wall surface extending in the pushing direction 1*c* from a radius end 211*a* of the shoulder portion 211. The radius end 211*a* of the shoulder portion 211 is a terminal end of the curved surface constituting the shoulder portion 211 on an inner side of the pushing hole 210. The point that the inner peripheral surface 212 extends in the pushing direction 1*c* means that a component of the pushing direction 1*c* is included in an extension direction of the inner peripheral surface 212. As will be described in more detail below, the inner peripheral surface 212 of the pushing hole 210 extends non-parallel (does not extend parallel) to the outer peripheral surface 20*a* of the punch 20.

When the formed portion 1 is pushed into the pushing hole 210 together with the punch 20, as shown in FIG. 6, a plate surface of the formed portion 1 is ironed by the shoulder portion 211. Further, an outer surface of the formed portion 1 slides along the inner peripheral surface 212 in response to relative displacement between the punch 20 and the die 21. In the ironing mold 2 according to this embodiment, as described above, the inner peripheral surface 212 extends non-parallel to the outer peripheral surface 20*a* of the punch 20, and therefore the inner peripheral surface 212 also irons (thins) the plate surface of the formed portion 1.

To ensure that the amount of ironing applied to the formed portion 1 remains constant in the pushing direction 1*c*, the inner peripheral surface 212 is provided with a clearance 212*a* that corresponds to the uneven plate thickness distribution, in the pushing direction 1*c*, of the formed portion 1 prior to ironing relative to the outer peripheral surface 20*a* of the punch 20. Here, the clearance 212*a* is a clearance between the inner peripheral surface 212 and the outer peripheral surface 20*a* at a point where the punch 20 is pushed into the pushing hole 210 up to a completion position of the ironing as shown in FIG. 5. The ironing amount is the difference between pre-ironing plate thickness $t_b$ and post-ironing plate thickness $t_a$ ($=t_b-t_a$).

In other words, the inner peripheral surface 212 is provided such that the clearance 212*a* relative to the outer peripheral surface 20*a* in any position in the pushing direction 1*c* takes a value obtained by subtracting a fixed value (the required ironing amount) from the plate thickness of the formed portion 1 prior to ironing in an identical position. When the clearance 212*a* in any position in the pushing direction 1*c* is noted as C(d), the plate thickness of the formed portion 1 prior to ironing in the same position is noted as $T_b(d)$, and the required ironing amount is noted as A, the inner peripheral surface 212 is provided to satisfy $C(d)=T_b(d)-A$. Note that d is the distance from the base portion 1*b* of the formed portion 1 in the pushing direction 1*c*.

To put it another way, the inner peripheral surface 212 is provided such that the clearance 212*a* between the inner peripheral surface 212 and the outer peripheral surface 20*a* decreases in the pushing direction 1*c* at an identical rate to the reduction rate of the plate thickness of the formed portion 1 in the pushing direction 1*c* prior to ironing. When the reduction rate of the plate thickness of the formed portion 1 in the pushing direction 1*c* prior to ironing is constant, the inner peripheral surface 212 is constituted by a rectilinear tapered surface that extends at an angle corresponding to the reduction rate of the plate thickness of the formed portion 1. When the reduction rate of the plate thickness of the formed portion 1 in the pushing direction 1*c* prior to ironing is uneven, on the other hand, the reduction rate of the plate thickness of the formed portion 1 is approximated to a fixed value, and the inner peripheral surface 212 is formed as a tapered surface that extends at an angle corresponding to the approximated value.

By forming the inner peripheral surface 212 in this manner, a load exerted on the surface of the formed portion 1 by the ironing process can be made uniform in the pushing direction 1*c* even when the plate thickness distribution of the formed portion 1 in the pushing direction 1*c* is uneven. Hence, generation of a large load in a part of the coating can be avoided, and therefore a situation in which a part of the surface treated layer is greatly shaved can be prevented. As a result, the amount of generated powdery residue (coating residue) can be reduced.

Figure 7:
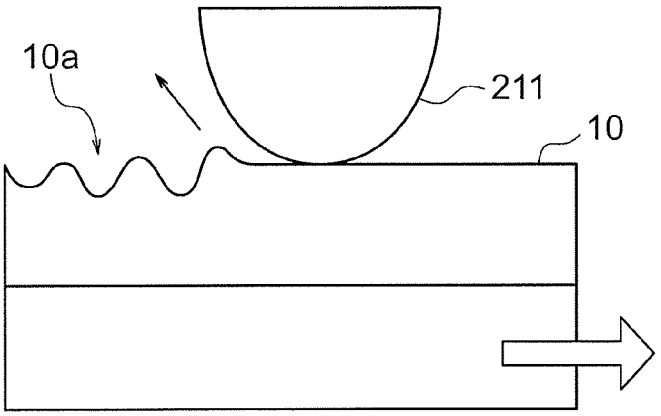
FIG. 7 is a schematic illustrative view showing a relationship between the shoulder portion of FIG. 6 and a coating layer of a Zn coated steel plate.

Next, referring to FIG. 7, a mechanism by which coating residue is generated due to the ironing performed by the shoulder portion 211 will be described. FIG. 7 is a schematic illustrative view showing a relationship between the shoulder portion 211 of FIG. 6 and a coating layer 10 of a Zn coated steel plate. As shown in FIG. 7, minute irregularities 10*a* exist on a surface of the coating layer 10 of the Zn coated steel plate. When the plate surface of the formed portion 1 is ironed by the shoulder portion 211, as shown in FIG. 6, the irregularities 10*a* may be shaved by the shoulder portion 211 so as to form ironing residue.

The amount of generated coating residue correlates with a ratio r/t between the curvature radius r of the shoulder portion 211 and the plate thickness t of the Zn coated steel plate. As the curvature radius r of the shoulder portion 211 decreases, local skewness increases, leading to an increase in sliding resistance between the surface of the coating layer 10 and the shoulder portion 211, and as a result, the amount of generated coating residue increases. Further, as the plate thickness t of the Zn coated steel plate increases, an amount of thinning performed by the shoulder portion 211 increases, leading to an increase in a load exerted on the surface of the Zn coated steel plate, and as a result, the amount of generated coating residue increases. In other words, the amount of generated coating residue increases as the ratio r/t decreases and decreases as the ratio r/t increases.

In particular, the plate surface of the pre-ironing formed portion 1 in a position sandwiched between the radius end 211*a* and the punch 20 upon completion of the ironing is thinned to the largest extent by the shoulder portion 211. From the viewpoint of suppressing the amount of generated coating residue, therefore, the amount of generated coating residue correlates strongly with a ratio $r/t_{re}$ between the curvature radius r of the shoulder portion 211 and a plate thickness $t_{re}$ of the pre-ironing formed portion 1 in the position sandwiched between the radius end 211*a* and the punch 20 upon completion of the ironing.

The amount of generated coating residue also correlates with the ironing rate applied by the shoulder portion 211. When the clearance between the radius end 211*a* and the punch 20 is noted as $c_{re}$ and the plate thickness $t_{re}$ of the pre-ironing formed portion 1 in the position sandwiched between the radius end 211*a* and the punch 20 upon completion of the ironing noted as $t_{re}$, the ironing rate is expressed by $\{(t_{re}-c_{re})/t_{re}\}\times 100$. The clearance $c_{re}$ corresponds to the plate thickness of the post-ironing formed portion 1 in the position sandwiched between the radius end 211*a* and the punch 20. As the ironing rate increases, the load exerted on the surface of the Zn coated steel plate increases, leading to an increase in the amount of generated coating residue.

Figure 8:
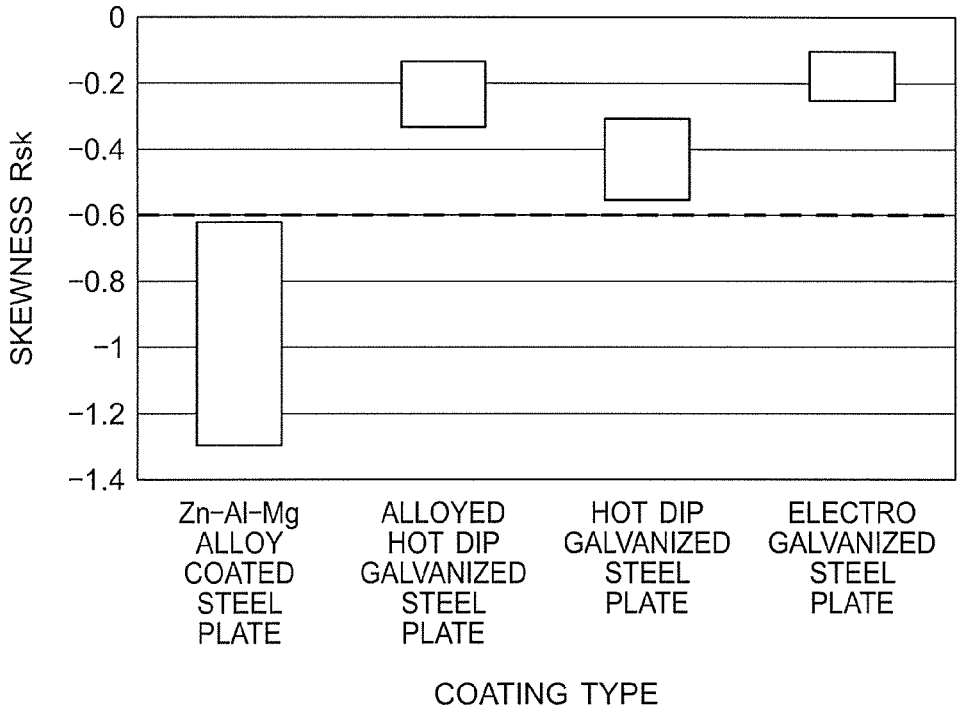
FIG. 8 is a graph showing a skewness Rsk of the coating layer shown in FIG. 6 in relation to various types of coating layers.

FIG. 8 is a graph showing a skewness Rsk of the coating layer 10 shown in FIG. 6 in relation to various types of coating layers. The amount of generated coating residue also correlates with the skewness Rsk of the coating layer 10. The skewness Rsk is defined by Japanese Industrial Standard B0601 and is expressed by the following equation.

$$Rsk = \frac{1}{Rq^3}\left\{\frac{1}{l_r}\int_0^{l_r} Z^3(x)\,dx\right\} \quad \text{[Eq. 1]}$$

Here, Rq is root mean square roughness (=square root of a second moment of an amplitude distribution curve), and $\int Z^3(x)dx$ is a third moment of the amplitude distribution curve.

The skewness Rsk represents an existence probability of projecting portions among the irregularities 10*a* (see FIG. 7) on the coating layer 10. As the skewness Rsk decreases, the number of projecting portions decreases, and therefore the amount of generated coating residue is suppressed. Note that the skewness Rsk has been described by the present applicant in Japanese Patent Application Publication 2006-193776.

As shown in FIG. 8, a Zn—Al—Mg alloy coated steel plate, an alloyed hot dip galvanized steel plate, a hot dip galvanized steel plate, and an electro galvanized steel plate may be cited as types of Zn coated steel plates. A typical Zn—Al—Mg alloy coated steel plate is formed by applying a coating layer constituted by an alloy containing Zn, 6% by weight of Al (aluminum), and 3% by weight of Mg (magnesium) to the surface of a steel plate. As shown in FIG. 8, the present applicant learned, after investigating the respective skewnesses Rsk of these materials, that the skewness Rsk of the Zn—Al—Mg alloy coated steel plate is included within a range of less than −0.6 and no less than −1.3, while the skewnesses Rsk of the other coated steel plates are included within a range of no less than −0.6 and no more than 0.

Figure 9:
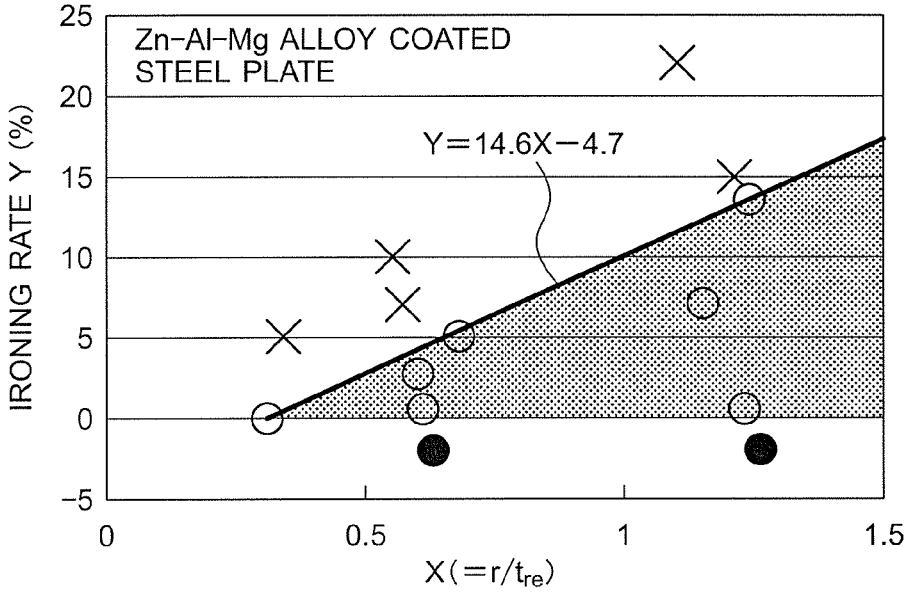
FIG. 9 is a graph showing a relationship between an ironing rate Y and X ($=r/t_{re}$) in relation to the Zn—Al—Mg alloy coated steel plate shown in FIG. 8.

FIG. 9 is a graph showing a relationship between an ironing rate Y and X (=$r/t_{re}$) in relation to the Zn—Al—Mg alloy coated steel plate. The present inventors performed ironing on the Zn—Al—Mg alloy coated steel plate under the conditions described below while modifying the ironing rate and $r/t_{re}$. Note that the plate thickness of the sample was 1.8 mm, and a coating coverage was 90 g/m$^2$.

TABLE 1

Chemical composition of sample (% by weight)

| Coating type | C | Si | Mn | P | S | Al | Ti |
|---|---|---|---|---|---|---|---|
| Zn—Al—Mg alloy coated steel plate | 0.002 | 0.006 | 0.14 | 0.014 | 0.006 | 0.032 | 0.056 |

TABLE 2

Mechanical properties of sample

| Coating type | Yield strength (N/mm$^2$) | Tensile strength (N/mm$^2$) | Elongation (%) | Hardness Hv |
|---|---|---|---|---|
| Zn—Al—Mg alloy coated steel plate | 164 | 304 | 49.2 | 87 |

TABLE 3

Experiment conditions

| | |
|---|---|
| Pressing device | 2500 kN Transfer Press |
| Height of pre-ironing formed portion | 10.5 to 13.5 mm |
| Curvature radius r of shoulder portion of forming mold | 1.5 to 4.5 mm |
| Curvature radius r of shoulder portion of ironing mold | 0.3 to 2.0 mm |
| Clearance of ironing mold | 1.10 to 1.80 mm |
| Press forming oil | TN-20 (manufactured by Tokyo Sekiyu Company Ltd.) |

The ordinate in FIG. 9 is the ironing rate, which is expressed by $\{(t_{re}-c_{re})/t_{re}\}\times 100$, and the abscissa is the ratio between the curvature radius r of the shoulder portion 211 and the plate thickness $t_{re}$ of the pre-ironing formed portion 1 in the position sandwiched between the radius end 211*a* and the punch 20 upon completion of the ironing, which is expressed by $r/t_{re}$. Circles show evaluations where it was possible to suppress coating residue generation, and crosses show evaluations where coating residue generation could not be suppressed. Further, black circles show results where the dimensional precision deviated from a predetermined range.

As shown in FIG. 9, in the case of the Zn—Al—Mg alloy coated steel plate, or in other words with a material in which the skewness Rsk is less than −0.6 and no less than −1.3, it was confirmed that coating residue generation can be suppressed in a region below a straight line denoted by $Y=14.6X-4.7$, where Y is the ironing rate and X is $r/t_{re}$. In other words, with a material in which the skewness Rsk is less than −0.6 and no less than −1.3, it was confirmed that coating residue generation can be suppressed by determining the curvature radius r of the shoulder portion 211 and the clearance $c_{re}$ between the radius end 211*a* and the punch 20 so as to satisfy $0<Y\leq 14.6X-4.7$. Note that in the above conditional expression, $0<Y$ is defined so that when the ironing rate Y is equal to or smaller than 0%, ironing is not performed.

Figure 10:
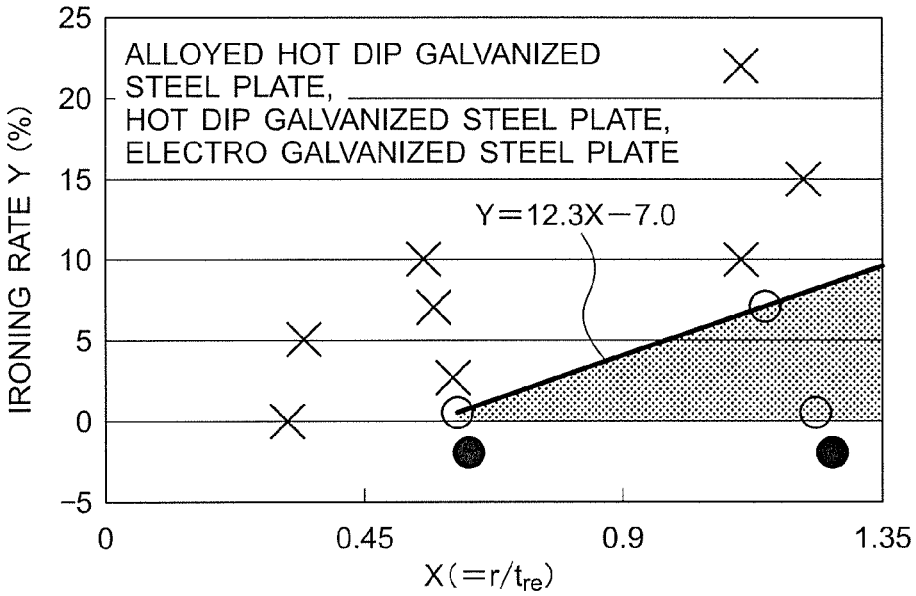
FIG. 10 is a graph showing the relationship between the ironing rate Y and X ($=r/t_{re}$) in relation to the alloyed hot dip galvanized steel plate, a hot dip galvanized steel plate, and the electro galvanized steel plate shown in FIG. 8.

FIG. 10 is a graph showing the relationship between the ironing rate Y and X (=$r/t_{re}$) in relation to the alloyed hot dip galvanized steel plate, the hot dip galvanized steel plate, and the electro galvanized steel plate shown in FIG. 8. The present inventors performed a similar experiment under conditions described below in relation to the alloyed hot dip galvanized steel plate, the hot dip galvanized steel plate, and the electro galvanized steel plate. Note that experiment conditions such as the pressing device (see Table 3) were identical to those of the ironing performed on the Zn—Al—Mg alloy coated steel plate, described above. Further, the alloyed hot dip galvanized steel plate and the hot dip galvanized steel plate had a plate thickness of 1.8 mm and a coating coverage of 90 g/m$^2$, while the electro galvanized steel plate had a plate thickness of 1.8 mm and a coating coverage of 20 g/m$^2$.

TABLE 4

Chemical composition of samples (% by weight)

| Coating type | C | Si | Mn | P | S | Al | Ti |
|---|---|---|---|---|---|---|---|
| Alloyed hot dip galvanized steel plate | 0.003 | 0.005 | 0.14 | 0.014 | 0.006 | 0.035 | 0.070 |
| Hot dip galvanized steel plate | 0.004 | 0.006 | 0.15 | 0.014 | 0.007 | 0.039 | 0.065 |
| Electro galvanized steel plate | 0.002 | 0.004 | 0.13 | 0.013 | 0.008 | 0.041 | 0.071 |

TABLE 5

| Mechanical properties of samples | | | | |
|---|---|---|---|---|
| Coating type | Yield strength ($N/mm^2$) | Tensile strength ($N/mm^2$) | Elongation (%) | Hardness Hv |
| Alloyed hot dip galvanized steel plate | 175 | 315 | 46.2 | 89 |
| Hot dip galvanized steel plate | 178 | 318 | 45.7 | 90 |
| Electro galvanized steel plate | 159 | 285 | 53.4 | 84 |

As shown in FIG. 10, in the case of the alloyed hot dip galvanized steel plate, the hot dip galvanized steel plate, and the electro galvanized steel plate, or in other words with materials in which the skewness Rsk is no less than −0.6 and no more than 0, it was confirmed that coating residue generation can be suppressed in a region below a straight line denoted by $Y=12.3X-7.0$, where Y is the ironing rate and X is $r/t_{re}$. In other words, with a material in which the skewness Rsk is no less than −0.6 and no more than 0, it was confirmed that coating residue generation can be suppressed by determining the curvature radius r of the shoulder portion 211 and the clearance $c_{re}$ between the radius end 211*a* and the punch 20 so as to satisfy $0<Y\leq 12.3X-7.0$.

Hence, in the ironing mold 2 and the formed material manufacturing method described above, to ensure that the amount of ironing applied to the formed portion 1 remains constant in the pushing direction 1*c*, the inner peripheral surface 212 is provided to have the clearance 212*a* that corresponds to the uneven plate thickness distribution, in the pushing direction 1*c*, of the formed portion 1 prior to ironing relative to the outer peripheral surface 20*a* of the punch 20, and therefore generation of a large load in a part of the surface treated layer (the coating layer 10) can be avoided, with the result that the amount of generated powdery residue (coating residue) can be reduced. By reducing the amount of generated powdery residue, problems such as formation of minute pockmarks (dents) in the surface of the ironed formed portion 1, deterioration of the performance of a product manufactured using the formed material, and the need for an operation to remove the powdery residue can be eliminated. This configuration is particularly effective when ironing is performed on a Zn coated steel plate.

Further, with a material in which the skewness Rsk is less than −0.6, the curvature radius r of the shoulder portion 211 and the clearance $c_{re}$ between the radius end 211*a* and the punch 20 are determined so as to satisfy a relationship of $0<Y\leq 14.6X-4.7$ between Y, which is expressed by $\{(t_{re}-c_{re})/t_{re}\}\times 100$, and X, which is expressed by $r/t_{re}$, and therefore the amount of powdery residue generated by the ironing performed by the shoulder portion 211 can be reduced.

Furthermore, with a material in which the skewness Rsk is no less than −0.6, the curvature radius r of the shoulder portion 211 and the clearance $c_{re}$ between the radius end 211*a* and the punch 20 are determined so as to satisfy a relationship of $0<Y\leq 12.3X-7.0$ between Y, which is expressed by $\{(t_{re}-c_{re})/t_{re}\}\times 100$, and X, which is expressed by $r/t_{re}$, and therefore the amount of powdery residue generated by the ironing performed by the shoulder portion 211 can be reduced.

Note that in the above embodiment, the surface treated metal plate is described as a Zn coated steel plate, but the present invention may be applied to other surface treated metal plates such as an aluminum plate having a painted film on the surface thereof, for example.

The invention claimed is:

1. An ironing mold for performing ironing on a convex formed portion formed using a surface treated metal plate as a raw material, comprising:

a punch that is inserted into the formed portion; and a die having a pushing hole into which the formed portion is pushed together with the punch, characterized in that the pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, and the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction, and a skewness Rsk of the surface treated metal plate is less than −0.6 and no less than −1.3, and that the curvature radius of the shoulder portion and the clearance between the radius end and the punch are determined such that when the curvature radius of the shoulder portion is set as r, the clearance between the radius end and the punch is noted as $c_{re}$, and a plate thickness of the formed portion prior to the ironing in a position that is sandwiched between the radius end and the punch upon completion of the ironing is noted as $t_{re}$, a relationship of $0<Y\leq 14.6X-4.7$ between Y, which is expressed by $\{(t_{re}-c_{re})/t_{re}\}\times 100$, X, which is expressed by $r/t_{re}$, is satisfied.

2. An ironing mold for performing ironing on a convex formed portion formed using a surface treated metal plate as a raw material, comprising:

a punch that is inserted into the formed portion: and a die having a pushing hole into which the formed portion is pushed together with the punch, characterized in that the pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, and the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction, and a skewness Rsk of the surface treated metal plate is no less than −0.6 and no more than 0, and that the curvature radius of the shoulder portion and the clearance between the radius end and the punch are determined such that when the curvature radius of the shoulder portion is set as r, the clearance between the radius end and the punch is noted as $c_{re}$, and a plate thickness of the formed portion prior to the ironing in a position that is sandwiched between the radius end and the punch upon completion of the ironing is noted as $t_{re}$, a relationship of $0<Y\leq 12.3X-7.0$ between Y, which is expressed by $\{(t_{re}-C_{re})/t_{re}\}\times 100$, and X, which is expressed by $r/t_{re}$, is satisfied.

3. The ironing mold according to claim 1, characterized in that the surface treated metal plate is a Zn coated steel plate formed by applying a Zn coating to a surface of a steel plate.

4. The ironing mold according to claim 2, wherein the surface treated metal plate is a Zn coated steel plate formed by applying a Zn coating to a surface of a steel plate.

5. A formed material manufacturing method comprising the steps of:

forming a convex formed portion by performing at least one forming process on a surface treated metal plate; and performing ironing on the formed portion using an ironing mold after forming the formed portion, characterized in that the ironing mold includes:

a punch that is inserted into the formed portion; and a die having a pushing hole into which the formed portion is pushed together with the punch, the pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction, and a skewness Rsk of the surface treated metal plate is less than −0.6 and no less than −1.3, and that the curvature radius of the shoulder portion and the clearance between the radius end and the punch are determined such that when the curvature radius of the shoulder portion is set as r, the clearance between the radius end and the punch is noted as $c_{re}$, and a plate thickness of the formed portion prior to the ironing in a position that is sandwiched between the radius end and the punch upon completion of the ironing is noted as $t_{re}$, a relationship of $0<Y\leq 14.6X-4.7$ between Y, which is expressed by $\{(t_{re}\ C_{re})\ /t_{re}\}\times 100$, and X, which is expressed by $r/t_{re}$, is satisfied.

6. A formed material manufacturing method comprising the steps of:

forming a convex formed portion by performing at least one forming process on a surface treated metal plate; and performing ironing on the formed portion using an ironing mold after forming the formed portion, characterized in that the ironing mold includes:

a punch that is inserted into the formed portion; and a die having a pushing hole into which the formed portion is pushed together with the punch, the pushing hole includes a shoulder portion disposed on an outer edge of an inlet of the pushing hole and constituted by a curved surface having a predetermined curvature radius, and an inner peripheral surface which extends from a radius end of the shoulder portion in a pushing direction of the formed portion, and along which an outer surface of the formed portion slides in response to relative displacement between the punch and the die, the inner peripheral surface extends non-parallel to an outer peripheral surface of the punch, and the inner peripheral surface is provided with a clearance that corresponds to an uneven plate thickness distribution, in the pushing direction, of the formed portion prior to the ironing relative to the outer peripheral surface to ensure that an amount of ironing applied to the formed portion remains constant in the pushing direction, and a skewness Rsk of the surface treated metal plate is no less than −0.6 and no more than 0, and that the curvature radius of the shoulder portion and the clearance between the radius end and the punch are determined such that when the curvature radius of the shoulder portion is set as r, the clearance between the radius end and the punch is noted as $c_{re}$, and a plate thickness of the formed portion prior to the ironing in a position that is sandwiched between the radius end and the punch upon completion of the ironing is noted as $t_{re}$, a relationship of $0<Y\leq 12.3X-7.0$ between Y, which is expressed by $\{(t_{re}-C_{re})\ /t_{re}\}\times 100$, and X, which is expressed by $r/t_{re}$, is satisfied.

7. The formed material manufacturing method according to claim 5, characterized in that the surface treated metal plate is a Zn coated steel plate formed by applying a Zn coating to a surface of a steel plate.

8. The formed material manufacturing method according to claim 6, characterized in that the surface treated metal plate is a Zn coated steel plate formed by applying a Zn coating to a surface of a steel plate.

* * * * *